US006024510A

United States Patent [19]

Kamienchick

[11] Patent Number: 6,024,510

[45] Date of Patent: Feb. 15, 2000

[54] DEVICE FOR SPEED RESTRICTION OF VEHICLES

[75] Inventor: Yehuda Kamienchick, Tivon, Israel

[73] Assignee: State of Israel, Ministry of Defense, Armament Develoment Authority, Haifa, Israel

[21] Appl. No.: 09/070,485

[22] Filed: Apr. 30, 1998

[51] Int. Cl.[7] ..... E01F 11/00; E01F 9/00

[52] U.S. Cl. ..... 404/15; 404/9

[58] Field of Search ..... 404/6, 9, 10, 15

[56] References Cited

U.S. PATENT DOCUMENTS

| | | | |
|---|---|---|---|
| 3,720,181 | 3/1973 | Elkins | 116/63 P |
| 5,306,105 | 4/1994 | Langbrandner et al. | 404/12 |
| 5,769,563 | 6/1998 | Flynn | 404/15 |

FOREIGN PATENT DOCUMENTS

| | | | |
|---|---|---|---|
| WO 91/19856 | 12/1991 | European Pat. Off. | 404/15 |
| 2030197 | 4/1980 | United Kingdom | 404/15 |

*Primary Examiner*—Thomas B. Will
*Assistant Examiner*—Gary S. Hartmann
*Attorney, Agent, or Firm*—Morgan & Finnegan, L.L.P.

[57] ABSTRACT

An adaptive speed restriction device is disclosed for use on roads against speeding vehicles. The device comprises an elongated hollow element having a preselected length defining a cavity, an impervious and elastic casing having at least one upper surface presenting a hump; at least one air outlet vent that allows for flow of air from inside the casing outwards to the open atmosphere when external pressure is exerted on the upper surface, the upper surface collapsible into a flat surface as air flows out of the cavity; and an air inlet vent that allows flow of air outside of the casing into the cavity when the external pressure is not exerted on the upper surface. When a vehicle passes over the hump, pressure is exerted on the upper surface which expels air outside through the air outlet vent. The maximum flow rate of air exiting the cavity is adaptive to the speed of the vehicle passing over the device. The air outlet vent can be adjusted to allow the device to accommodate various allowed vehicle speeds.

8 Claims, 6 Drawing Sheets

DEVICE FOR SPEED RESTRICTION OF VEHICLES

The present invention relates to a speed restriction device. More particularly it relates to an adaptive speed restriction device.

BACKGROUND OF THE INVENTION

Today's motorized traffic requires various means of control, especially with respect to speeding. A common feature in many urban roads are the speed restriction humps. These speed restriction humps are designed to impose an obstacle to speeding vehicle passes over such a hump the vehicle is rocked, imposing significant inconvenience to the driver and passengers. An experienced driver slows down to pass over such humps in a relatively slow speed, in order to avoid the shock, thus traffic speed restriction is obtained. The faster the vehicle is driven over the hump the harder is the rocked.

Widely in use are the concrete or the asphalt road humps. However, being made of rigid materials, these road humps impose inconvenience to all vehicles passing over them, even to such vehicles driven at a slow, legal speed.

In the U.K. Patent. 2,030,197 (Williams et al.) a portable road vehicle speed restriction was described. It comprises a plurality of individually portable, rigid or semi-rigid members, each having a flat base and an upper surface which is shaped to present a hump. These members were adapted to be assembled side by side to form an elongate hump of continuous uniform section accross the path of road vehicles.

It is an object of the present invention to provide an adaptive speed restriction hump which will efficiently impose a speed restriction on vehicles speeding over the allowed legal speed, and yet minimize the inconvenience for obedient drivers driving at speed within the allowed speed limit.

It is yet another object of the present invention to provide a speed restriction hump being capable of adjusting its restriction properties in order to impose a variety of effective speeding restrictions with respect to different speed limits.

BRIEF DESCRIPTION OF THE INVENTION

According to the present invention an adaptive speed restriction device is disclosed, comprising a hollow element of a predetermined length, having an impervious casing consisting of at least one upper surface presenting a hump, said upper surface being elastic and resilient, having at least one vent, located on said casing, and allowing for the flow of air at a predetermined rate, directed from the space inside said casing outward, said casing being provided with means for allowing the flow of outside air into the space within the casing.

BRIEF DESCRIPTION OF THE DRAWINGS

FIG. 1, illustrates two typical embodiments of the adaptive speed restriction device according to the present invention.

FIG. 2, demonstrates the operation of the adaptive speed restriction device according to the present invention when a vehicle passes over it.

DETAILED DESCRIPTION OF THE INVENTION AND DRAWINGS

FIG. 1 illustrates two typical embodiments of the adaptive speed restriction device according to the present invention.

Figure 1A:
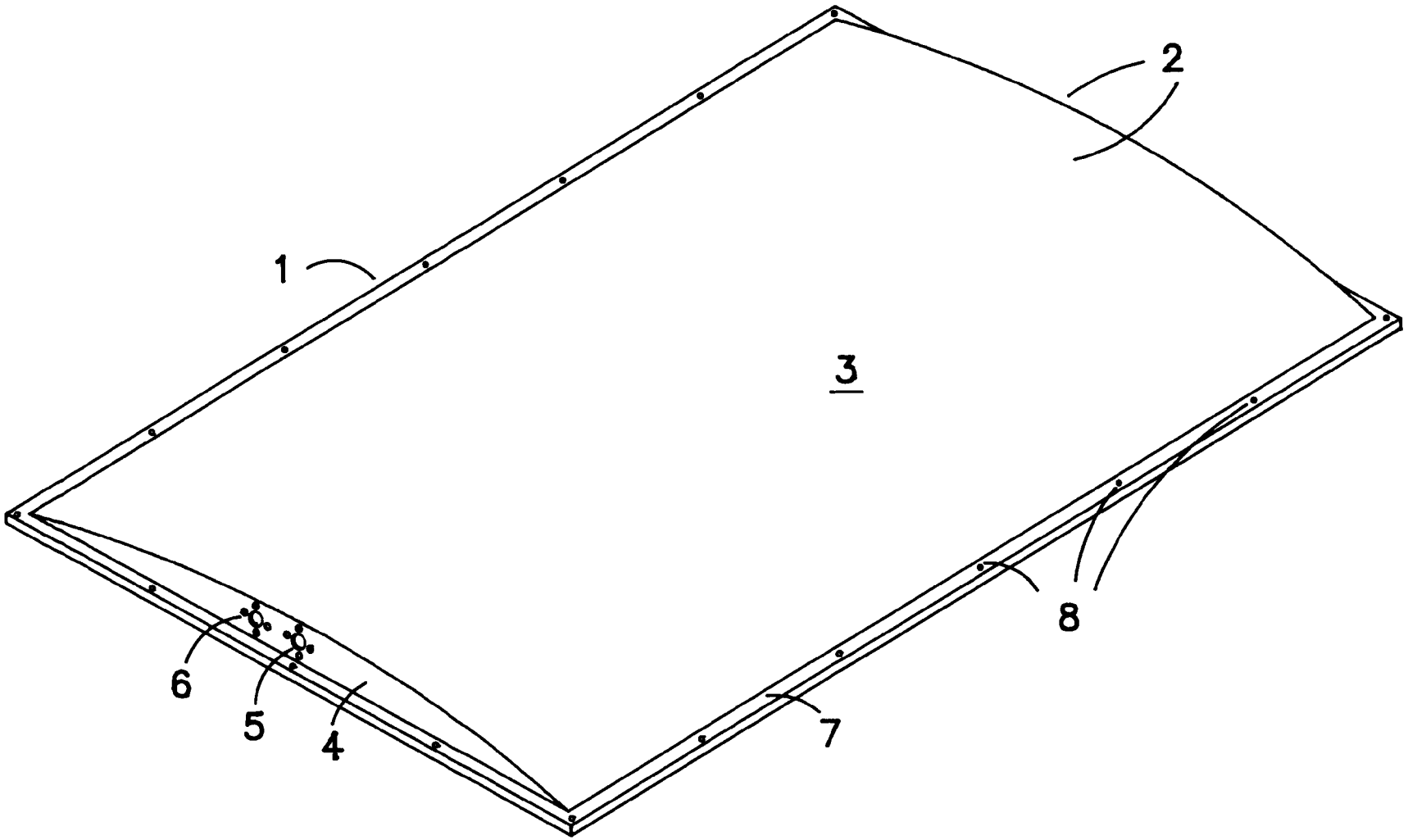
FIG. 1*a* illustrates an adaptive speed restriction device.

FIG. 1*a* illustrates an adaptive speed restriction device. It comprises a hollow, elongated element (1), consisting of an impervious casing (2). The device has an elastic, resilient upper surface presenting a hump (3). On the side wall (4) of the casing two vents are provided: one vent (5) allows air to flow, up to a predetermined maximum flow rate, from the space within the casing outwardly or in the opposite direction. The other vent (6) is a valve, allowing for the air to flow only in one direction: from outside the casing into the space within the casing. The device casing is provided with a frame (7) having bores (8) suited for screws or nails to be used for fixing the device in place onto the road surface.

Figure 1B:
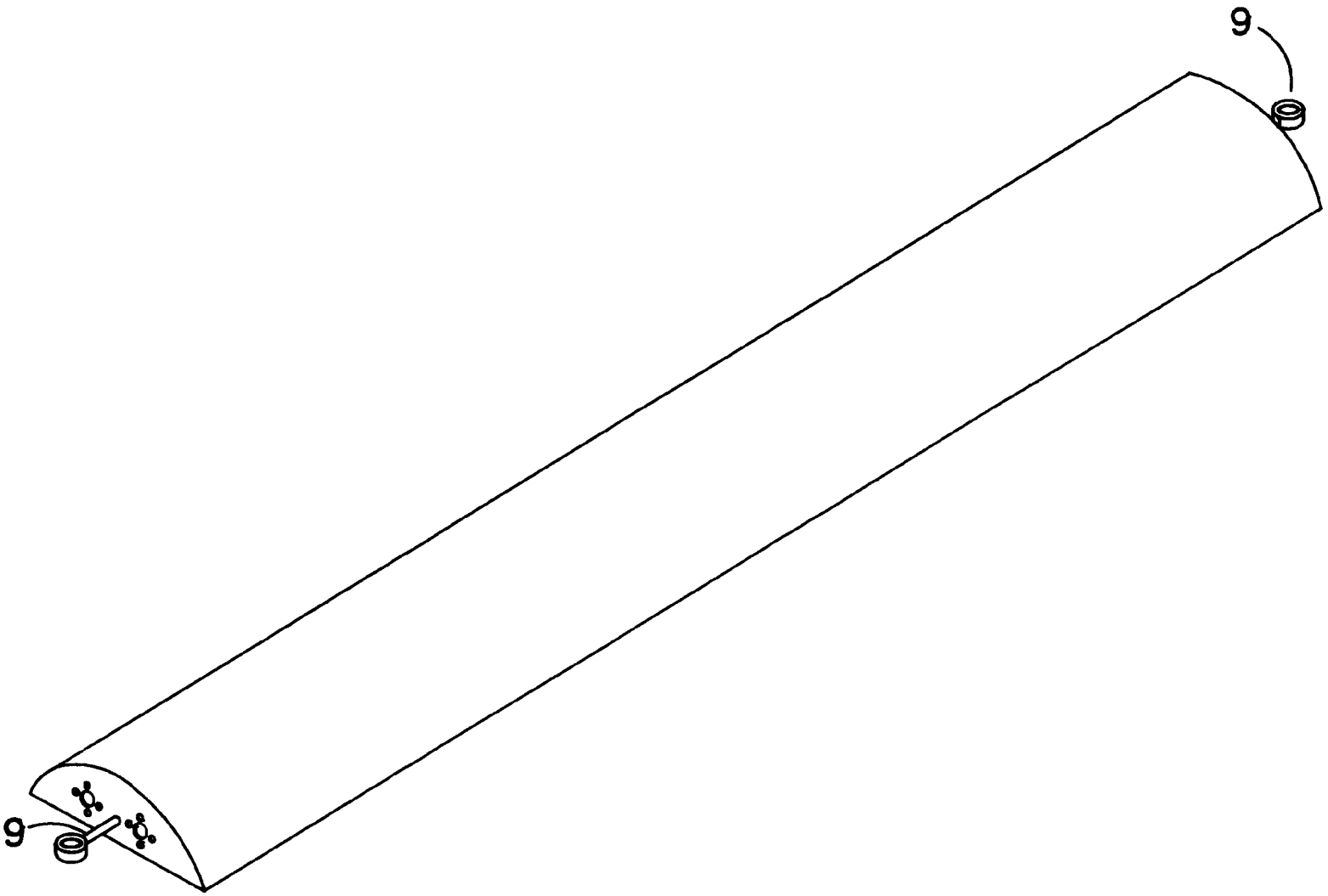
FIG. 1*b* illustrates another embodiment of the device according to the present invention.

Another typical embodiment of the present invention is illustrated in FIG. 1*b*. At each end of the element there are anchoring means (9) for fixing the device in place and for a quick and efficient discard.

In the embodiments of the present invention, the upper surface of the device, possesses elastic and resilient properties, which can be achieved by using elastic materials such as synthetic rubber (as used for car tires) or other materials having these properties.

Reference is now made to FIG. 1*a,* wherein the upper surface of the speed restriction device shown has one or more vents, located substantially near the upper surface ends, so that the passing vehicle will not obstruct the vent action.

The vent (5) has a predetermined or an adjustable aperture, so as to allow for a predetermined maximal flow of the air through it, when the upper surface (3) is subjected to external pressure produced by a passing vehicle.

The device casing (2) is impervious in order to prevent the air within the device casing from escaping other than through the vent. The device of the present invention is placed across the traffic lane to be controlled, so that any vehicle traveling on that line will be forced to pass over the device and consequently be forced to slow down to a predetermined allowed speed.

Figure 2A:
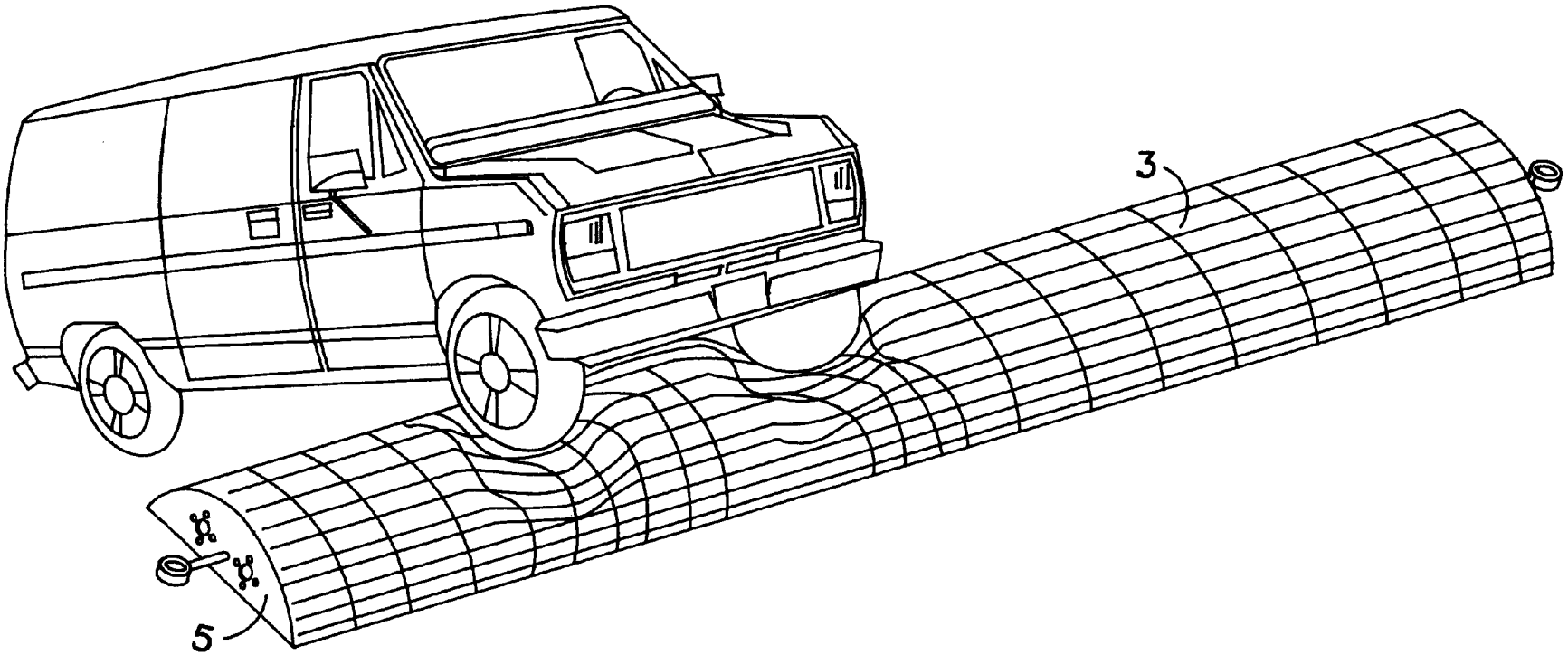
FIG. 2*a* illustrates the operation of the device according to the present invention under a pressure imposed by a traveling at the predetermined maximum allowed speed (or less).
Figure 2B:
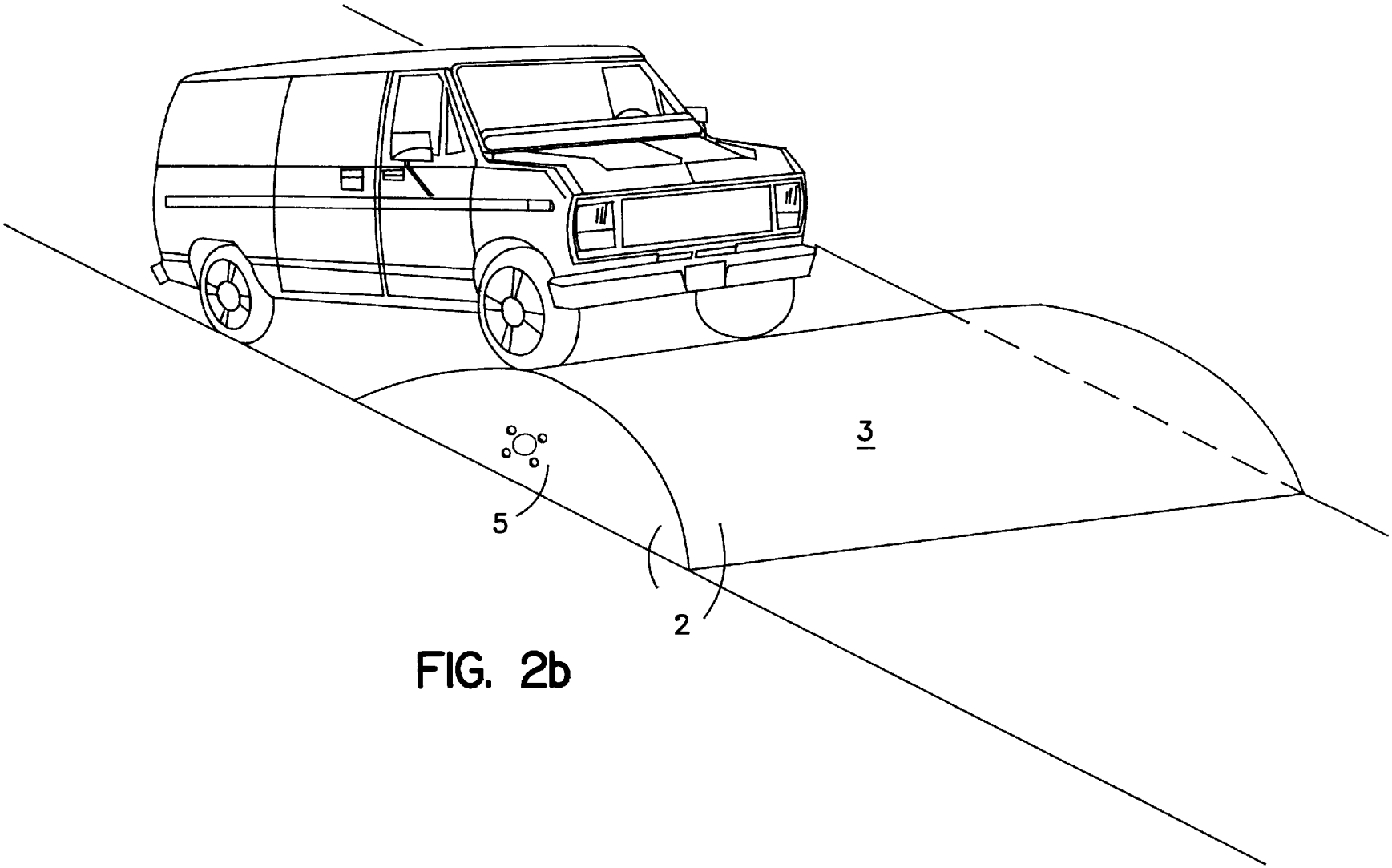
FIG. 2*b* illustrates the operation of the device according to the present invention under a pressure impact imposed by a vehicle traveling at a speed greater than the allowed predetermined speed.

When a vehicle passes over the speed restriction device according to the present invention (FIG. 2), it exerts pressure onto the upper surface (3) in contact with the respective wheels, which is transformed to the air present inside the device casing. The pressurized air within the device casing can escape only through the vent (5) , wherein the vent's aperture is set to allow for a predetermined maximal flow rate of air. When the said vehicle is traveling at a speed lower or equal to the predetermined maximal allowed speed (FIG. 2*a*) the vent (5) allows for a relatively free flow of the air from under the upper surface of the device, and the upper surface (3) collapses under the weight of the vehicle to present a substantially flat surface. The driver as well as the passengers in the vehicle will feel very little, if any, inconvenience when passing over the speed restriction device.

However, if the vehicle passing over the device as described in the present invention is traveling at a speed greater than the predetermined allowed speed (FIG. 2*b*), than the rate of pressure build-up imposed by the impact of the vehicle on the upper surface (3) of the speed restriction device would be greater than in the earlier case, and the predetermined aperture of the vent (5) will not suffice for a thorough exhaustion of the air from the device casing (2). As a result, the upper surface (3) of the device will not collapse totally and the passing vehicle will be rocked by the still present hump. It is quite clear that for all speeds greater than the predetermined allowed speed, the greater the speed of the passing vehicle, the higher the hump will remain and accordingly the shock of the impact will be greater. The resulting inconvenience for the driver and the passengers will be greater too.

Figure 3:
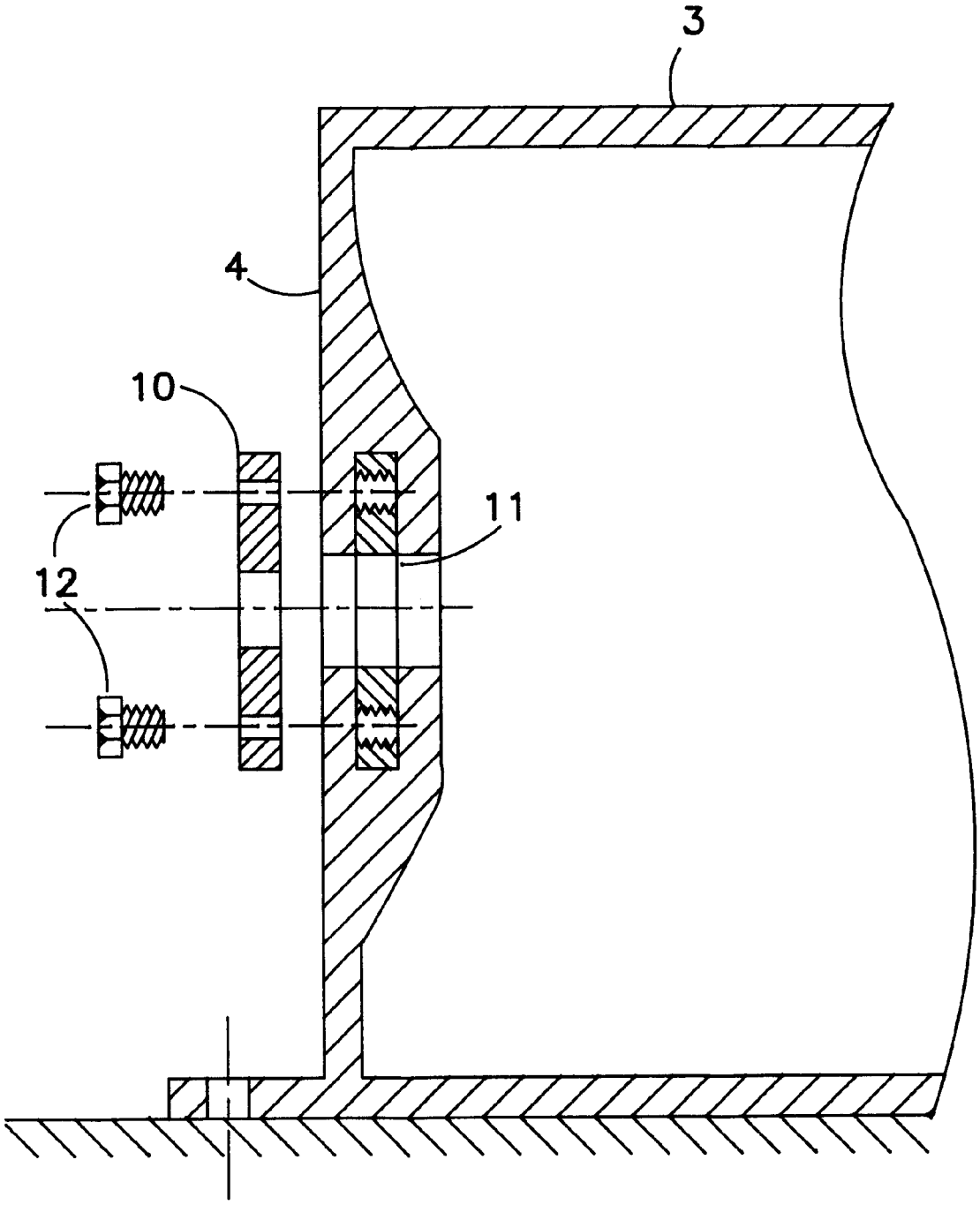
FIG. 3, depicts a vent suitable for use in the device of the present invention, with adjustable aperture.

Optionally, the vent aperture is made to be adjustable (FIG. 3). In this way the speed restriction device can be used in different traffic conditions, and would impose speed restrictions for various speeds as desired. A larger aperture will impose a faster speed limit whereas a smaller aperture will impose a slower speed limit.

In the typical example as illustrated in FIG. 3 the aperture diameter is determined by a replaceable aperture disk (10), which is mounted over the basic aperture (11), the latter being suitable for determining the maximum possible allowed speed (e.g. the highest allowed legal speed limit for highways), and secured in place by screws (12). The replaceable aperture disk (10) should have a smaller aperture than the basic aperture (11) which will impose a lower speed limit consequently. By providing a set of different aperture disks, each having a different size aperture, this embodiment would enable a flexible use of the device in a variety of speed limits as desired by the user.

Another advantage of the device of the present invention is its mobility, which enables to be used for temporary speed restrictions, as in the case of traffic control near road repair works, at events controlled by police, where temporary speed restrictions are demanded, like on a traffic accident location, etc.

Figure 4:
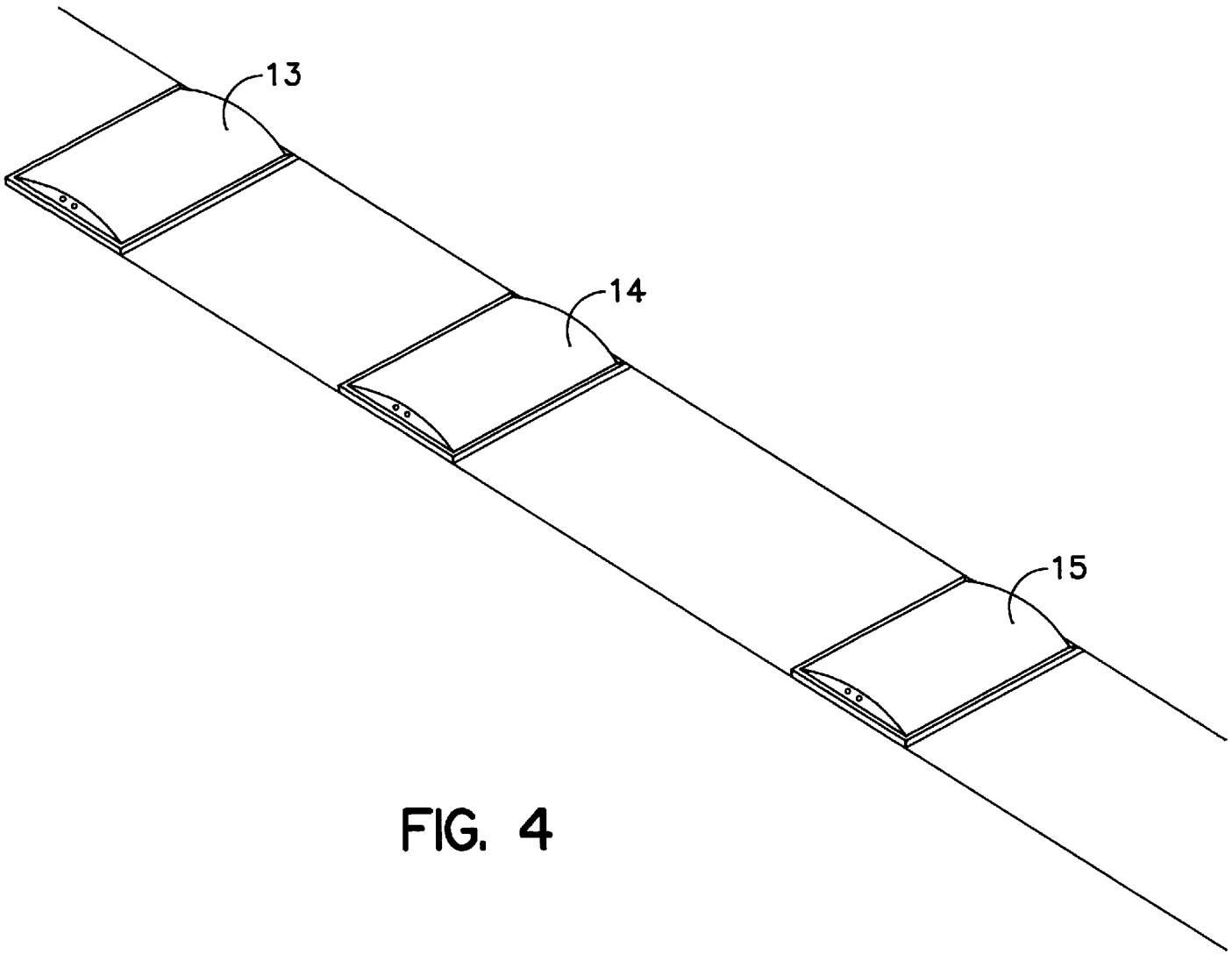
FIG. 4, illustrates another typical use of the adaptive speed restriction device according to the present invention, wherein a plurality of elements is laid parallel to each other, at predetermined distance apart.

An optional use of the present invention would require a plurality of elements, laid parallel to each other, at predetermined distances apart (FIG. 4). The first adaptive speed restriction device (13) in the direction of traffic would be set to impose a relatively high speed restriction, followed by the next device (14) set to impose slower speed restriction, and so on (15). This embodiment is most preferred for use when a temporary speed restriction is required on a highway where the traffic is heavy and fast.

It should be pointed out that the embodiments as described herein and the attached Figures are presented for illustrative purposes only, without limiting the scope of the invention as shown in the appending Claims.

I claim:

1. An adaptive speed restriction device, comprising an elongated hollow element of a predetermined length defining a cavity, the element having an impervious casing consisting of at least one upper surface presenting a hump, said upper surface being elastic and resilient, having at least one air outlet vent, located on said casing that allows flow of air at a predetermined maximum flow rate, from the cavity within said casing outward of said casing in response to external pressure exerted on said upper surface, said upper surface collapsing into a flat surface as air flows outward of said casing, said casing being provided with an air inlet vent that allows flow of air outside of said casing into the cavity when said external pressure is not being exerted on said upper surface thereby reforming said hump as air flows into the cavity.

2. The device according to claim 1, wherein said vent is provided with an adjustable aperture.

3. A device according to claim 2, wherein a replaceable aperture disk is mounted over the air outlet vent to provide the adjustable aperture.

4. The device according to claim 1, wherein the casing has at least one side wall on which said air outlet vent is located.

5. The device according to claim 1, wherein said casing is provided with a frame.

6. The device according to claim 5, wherein said frame is provided with bores suited for screws or nails for fixing said device onto a road surface.

7. The device according to any of claim 1, wherein said device has anchoring means at its ends.

8. A device according to claim 1, wherein the air inlet vent is a unidirectional valve.

* * * * *